US006997860B2

(12) United States Patent
Opfer

(10) Patent No.: US 6,997,860 B2
(45) Date of Patent: Feb. 14, 2006

(54) SINGLE DRIVE CENTRIFUGAL SEPARATOR

(75) Inventor: Mark H. Opfer, Pemberville, OH (US)

(73) Assignee: Glassline Corporation, Perrysburg, OH (US)

( * ) Notice: Subject to any disclaimer, the term of this patent is extended or adjusted under 35 U.S.C. 154(b) by 110 days.

(21) Appl. No.: 10/642,793

(22) Filed: Aug. 18, 2003

(65) Prior Publication Data

US 2005/0043164 A1 Feb. 24, 2005

(51) Int. Cl.
*B04B 9/00* (2006.01)
*B04B 11/08* (2006.01)

(52) U.S. Cl. ..... 494/55; 494/84

(58) Field of Classification Search ..... 494/50–55, 494/58, 84; 210/372–377
See application file for complete search history.

(56) References Cited

U.S. PATENT DOCUMENTS 2,443,593 A * 6/1948 Birsch
2,731,151 A * 1/1956 Hopper
2,761,564 A * 9/1956 Tholl et al.
2,906,466 A * 9/1959 Hopper
3,403,848 A * 10/1968 Windsor et al.
3,741,465 A * 6/1973 Lincoln
3,761,014 A * 9/1973 Carter
3,851,819 A * 12/1974 Tadokoro
4,223,829 A * 9/1980 Bange
4,234,123 A * 11/1980 Cory
4,416,655 A * 11/1983 Bennett
4,522,620 A * 6/1985 Leister
5,250,180 A * 10/1993 Chang
5,362,293 A * 11/1994 Romanauskas
5,454,777 A * 10/1995 Ziems et al.
5,512,031 A * 4/1996 Ziems et al.
5,879,279 A * 3/1999 Berger et al.
5,916,082 A 6/1999 Opfer
6,126,587 A * 10/2000 Berger et al.
6,149,573 A 11/2000 Berger et al.
6,224,532 B1 5/2001 Beattey
6,248,054 B1 * 6/2001 Berger et al.
6,251,056 B1 * 6/2001 Berger et al.
6,478,724 B1 11/2002 Beattey
2003/0013592 A1 * 1/2003 Beattey
2005/0003945 A1 * 1/2005 Beattey
2005/0043164 A1 * 2/2005 Opfer

FOREIGN PATENT DOCUMENTS

GB 2393142 * 3/2005

* cited by examiner

*Primary Examiner*—Charles E. Cooley
(74) *Attorney, Agent, or Firm*—Emch, Schaffer, Schaub & Porcello Co., L.P.A.

(57) ABSTRACT

This apparatus is a centrifugal separator comprising a centrifuge bowl; a hollow spindle connected to the bowl; a scraper located within the interior of the bowl; a shaft connected to a scraper, the shaft extending through the hollow spindle; a single drive member directly engaged to the shaft for inducing rotation of the scraper within the bowl. A clutch is engaged between the shaft and spindle. In a high speed separation operation, the clutch engages and the bowl and scraper rotate at the same speed.

16 Claims, 3 Drawing Sheets

SINGLE DRIVE CENTRIFUGAL SEPARATOR

TECHNICAL FIELD

This invention relates to a centrifugal separation device for separating solids from contaminated effluent such as oil base coolants and other liquids which are used in a variety of grinding and machining applications in the glass, ceramic and metal-forming industries.

BACKGROUND OF THE INVENTION

Known centrifugal separation devices commonly use a drive motor for the scraper blade and a drive motor for the bowl, with both motors being indirectly coupled to the scraper blade and the bowl through belts and pulleys. Strobe devices are used to synchronize the drive motors and the rotational speed of the scraper and bowl. Other prior art centrifugal separators also commonly use a friction clutch to synchronize the rotational speeds of the blades and the bowl. Friction clutches, however, have a tendency to wear and slip and, therefore, do not provide consistent synchronous blade and bowl rotation, especially during drag-inducing conditions such as start up and the injection of the particle contaminated fluid into the bowl during operations.

The centrifuge separator of U.S. Pat. No. 6,149,573 provides a solution to the slippage issues surrounding synchronization of the speeds of the bowl and blade. A centrifugal clutch is engaged to link the blade with the bowl during centrifuge operations. The clutch is disengaged when blade operation is necessary to scrape the inside of the bowl. Separate drive motors are engaged with the blade and bowl respectively. The use of separate drive motors remains an undesirable, complicated and costly feature of the '573 patent.

The complications of the '573 are resolved, in part, by the structure shown in U.S. Pat. No. 6,478,724. In one embodiment of the '724 patent (FIGS. 3–6), a spindle is attached to the centrifuge bowl and a shaft, centered within the spindle for independent rotation, is engaged with the scraper mechanism. A shiftable clutch assembly operable to engage with two sets of interlocking teeth shifts the motive force between the spindle, shaft and a combination of both. In a first position, the clutch engages the spindle and shaft together so the bowl and scraper are driven to rotate synchronously. In a second position, the first and second sets of teeth are disengaged and the scraper is free to rotate on its own. Both spindle and shaft are engaged with a single driver motor in a belt and pulley combination. We believe the mechanical structure needed for the centrifuge of the '724 patent to still be unnecessarily complicated and costly. Further, undesirable slippage of the belt/pulley drive mechanism will occur under loaded operations.

A recent invention provides an apparatus for enhancing the operation of a centrifugal separator and automatically adjusting for varying amounts of solids in the contaminated fluid being passed through the separator. That invention includes a load sensing circuit which monitors the load on the drive motor of the separator centrifuge bowl and signals for a cleaning cycle based upon the load information. See U.S. Pat. No. 5,454,777, which is incorporated herein by reference.

The separator of the '777 patent requires a first drive motor for rotating the centrifuge bowl and a second drive motor for rotating the scraper blades. A load sensing device in combination with a programmable logic controller (PLC) co-operate to coordinate the operation of the separate motors.

It is therefore an object of this invention to provide a centrifugal separate having a single drive motor, yet being less complicated mechanically and less costly than those shown in the prior art.

It is a further object of this invention to provide a direct drive to the bowl and scraper mechanism to eliminate the potential for slippage such as that created by loading of the prior art gear/chain, belt pulley engagements from the drive motor to the spindle and shaft.

Yet another object of the invention is to provide a direct drive incorporating a servo motor capable of performing the load sensing methodology described and claimed in U.S. Pat. No. 5,454,777, eliminating the need for a load sensing circuit and a PLC.

SUMMARY OF THE INVENTION

The centrifugal separator of this invention includes a centrifuge bowl defining an axial centerline. The bowl has an interior, an interior surface, an upper end and a lower end, wherein the lower end has an opening communicating with the interior. A hollow spindle aligned with the axial centerline of the bowl is engaged with the upper end of the bowl. The hollow interior of the spindle opens to the interior of the bowl. A scraper mechanism is located within the interior of the bowl. A scraper shaft extends through the hollow spindle and is directly engaged with a drive motor. A clutch mechanism, such as a centrifugal clutch, air clutch, or electromagnetic clutch, is positioned between the scraper shaft and the spindle. When the clutch is engaged, the bowl and scraper blades will rotate synchronously. When the clutch is disengaged, only the scraper blade will rotate as it is directly driven by the drive motor.

The directly connected drive motor greatly simplifies the structure of the centrifugal separator. It eliminates the need for belts/pulleys, chains/sprockets, second drive motor, reducer and bearings.

Further advantages of directly coupling the drive motor to the scraper shaft include elimination of slippage due to the use of belts and pulleys, as well as the elimination of radial or side loading on the bearings as a result of indirectly mounted drive motors.

The directly connected drive motor is preferably a servo motor and load sensing for the centrifuge can be accomplished without need of a load sensing circuit and a PLC. Further, the use of a direct drive to the scraper shaft puts less stress on the clutch mechanism as it engages only to bring the bowl up to speed. At low rotational speeds, the clutch is disengaged from the bowl and at high rotational speeds, the clutch is engaged to rotate the blade and the bowl at synchronous speeds.

Further details of the invention will be more readily understood when viewing the following drawings and detailed description of the preferred embodiment.

DETAILED DESCRIPTION OF THE PREFERRED EMBODIMENT(S)

Figure 1:
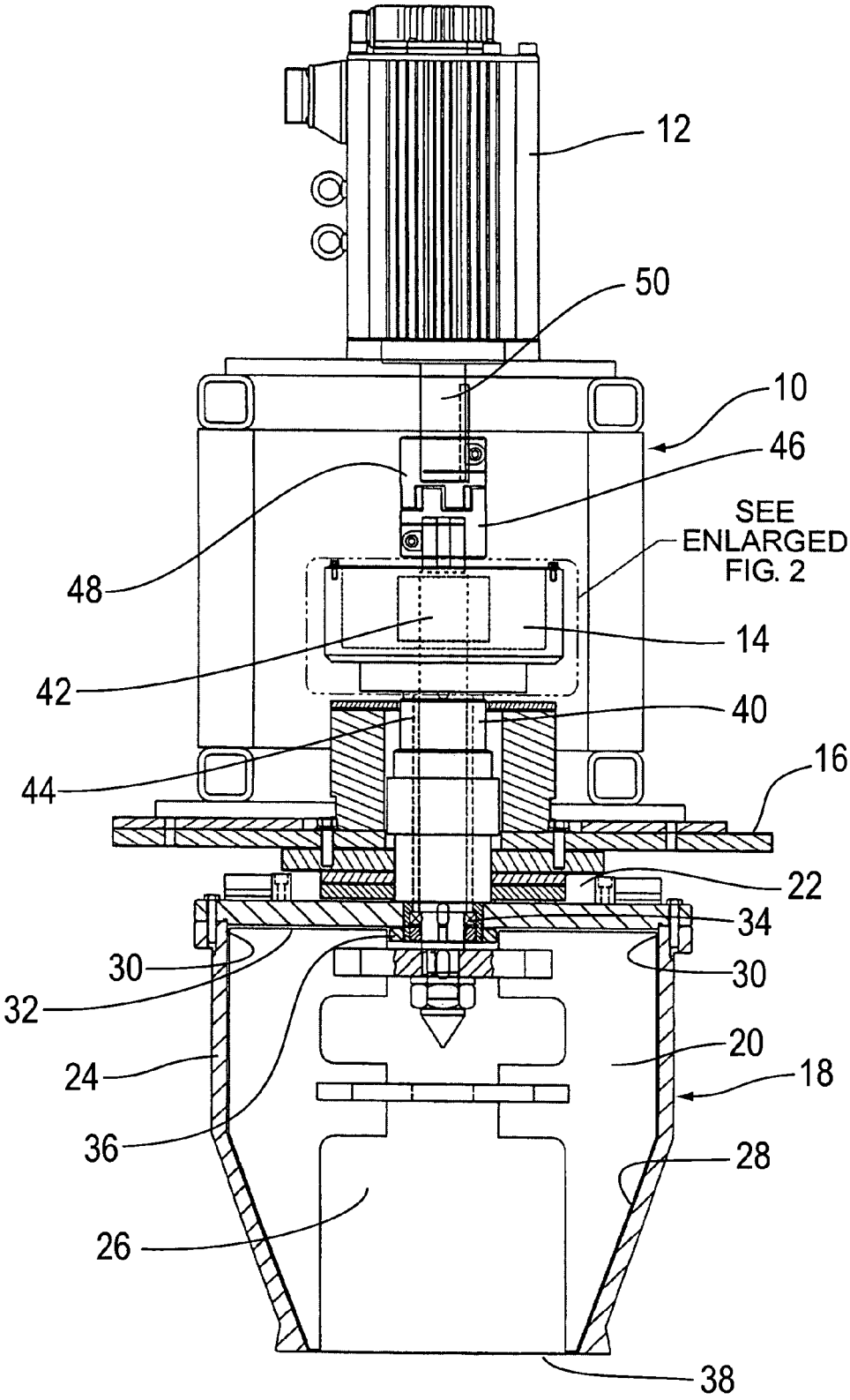
FIG. 1 is a partial sectional side view of the centrifugal separator of the present invention.

Referring now to FIG. 1, the centrifugal separator of this invention includes a frame 10, preferably constructed of tubular steel, designed to support the drive motor 12 and clutch 14. In a preferred embodiment, the clutch 14 is a centrifugal clutch, however, other clutch mechanisms are acceptable (i.e. any clutch actuated by air, electromagnetic, etc.). The frame is usually supported by a flat steel table 16. The bowl 18 is supported on the table 16 by rotational bearings 22. The centrifugal bowl 18 has a hollow bowl-shaped body 24 defining an open interior 26 and an interior bowl surface 28. The top edge 30 of the bowl is capped by a top plate 32. The top plate 32 has a hole 34 extending therethrough at the centerpoint defined by an axial centerline about which the bowl rotates. The bottom 38 of the bowl 18 is open. The scraper blade 20 is mounted within the interior of the bowl 18 by bearing 36 and rotates about the axis centerline. The drive motor 12 is aligned with the axis centerline of the bowl 18.

A spindle member 40, which is hollow 44 along the axial centerline, is engaged between the top plate 32 of the bowl 18 and the clutch 14. A shaft 42 extends through the hollow 44 and the clutch 14. One end of the shaft 42 is fixed to a first coupling member 46 and the opposed end of the shaft 42 is engaged with the scraper blade 20. A second coupling 48 mates with the first coupling 46 and is directly engaged with the drive motor 12 by the drive shaft 50. Operation of the drive motor 12 therefore provides direct rotational force to the scraper blade.

Figure 2:
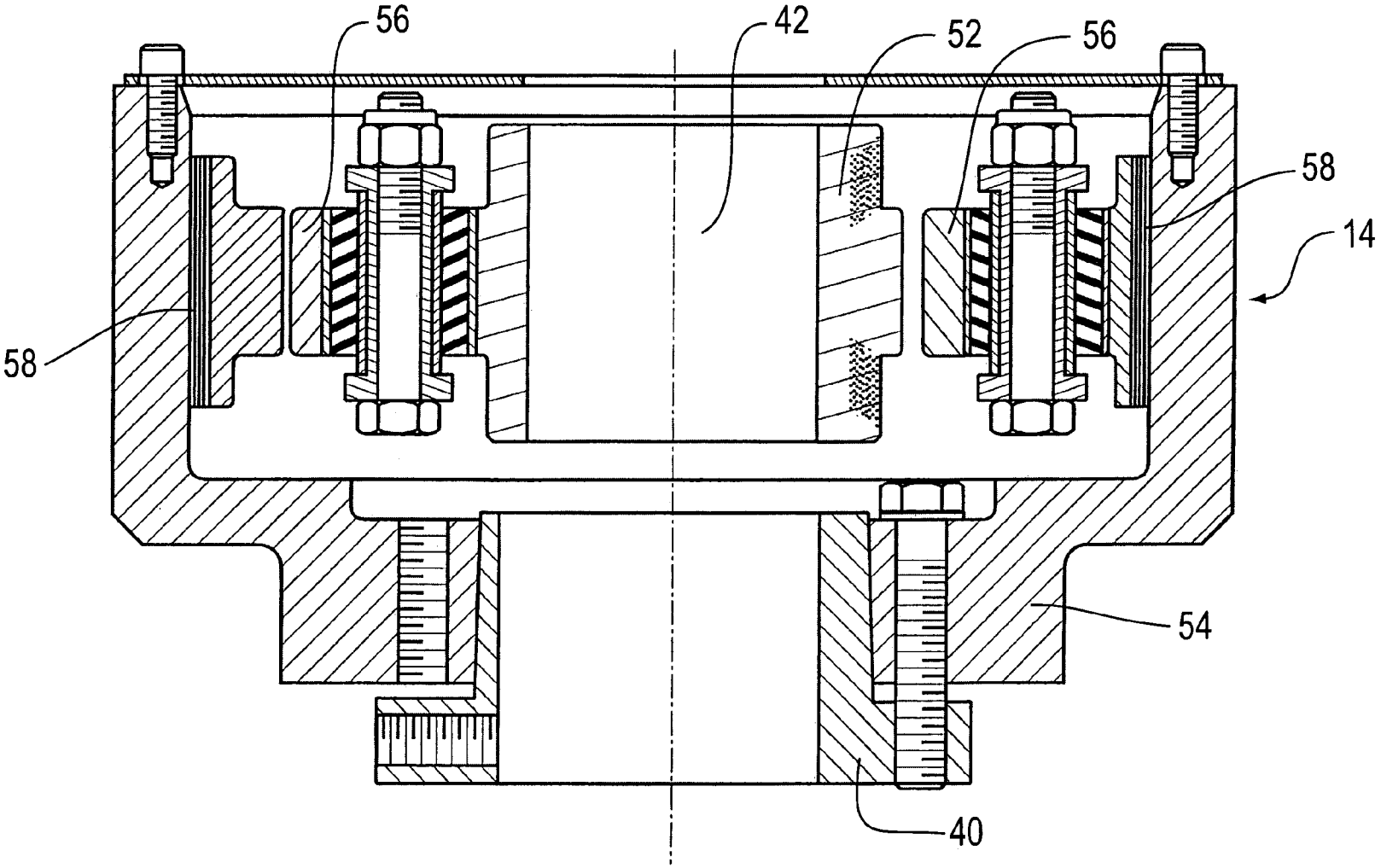
FIG. 2 is a sectional side view of a centrifugal clutch intended for use with the centrifugal separator of FIG. 1.
Figure 3:
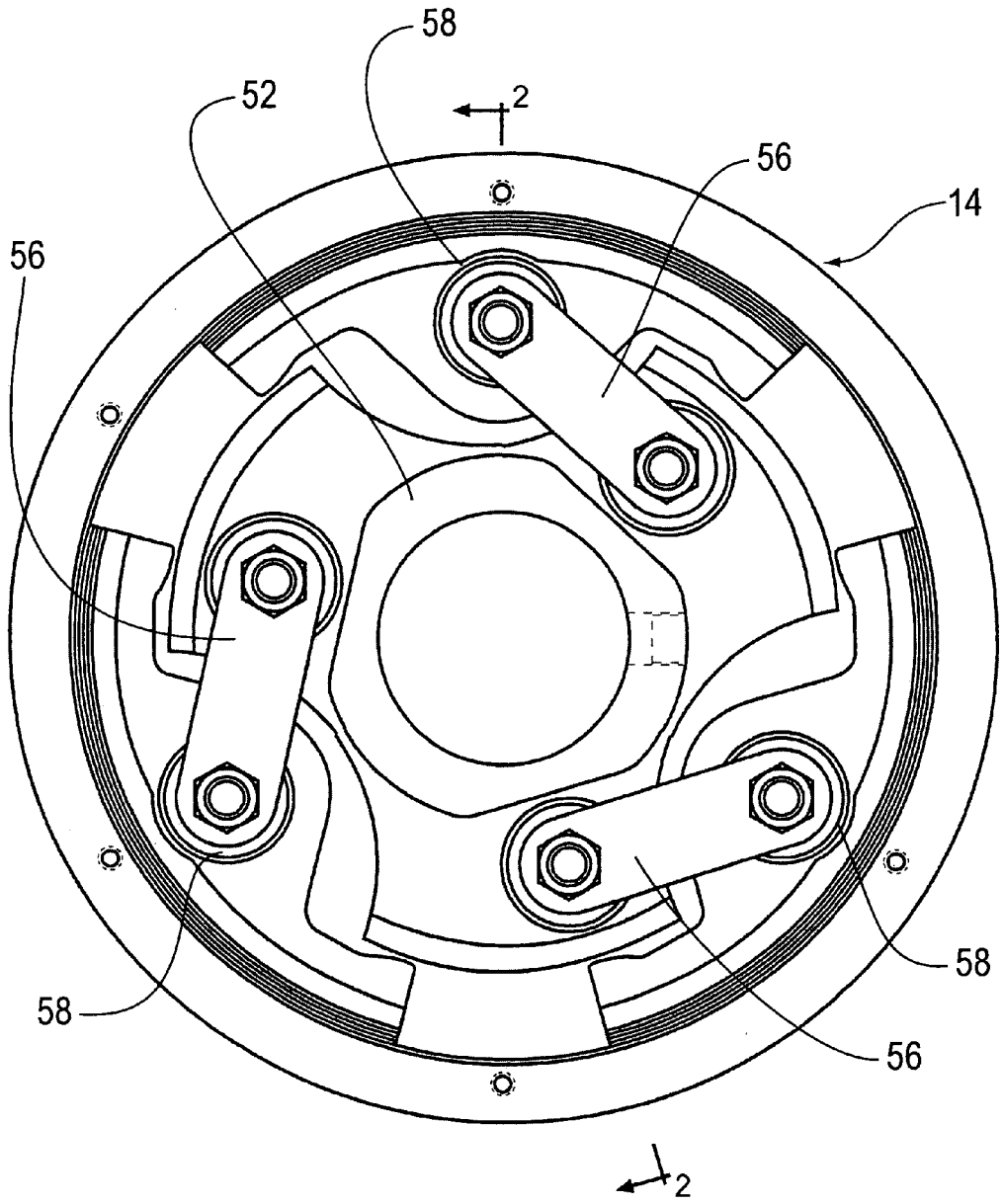
FIG. 3 is a top plan view of the centrifugal clutch of FIG. 2.

Referring now to FIGS. 2 and 3, the centrifugal clutch which may be used with the invention includes an inner collar 52 which is fixed to the shaft 42 and a bell housing 54 which is engaged with the spindle 40. A plurality of clutch shoes 56 and pads 58 are resiliently positioned on the collar 52 such that when the shaft 42 is not in motion or is operating at predetermined low threshold RPM (for example only, less than 450 RPM) the clutch pads 58 are disengaged from the bell housing 54. If the rotational speed of the shaft 42 exceeds the predetermined threshold, then the clutch shoes 56 are centrifugally spun out against the resilient bias and the clutch pads 58 engage the bell housing 54, thereby applying a rotational driving force to the bowl 12 through the spindle 40. The scraper blade 20 and centrifugal bowl 12 then rotate in synchronous speed.

The operation of the preferred embodiment of the centrifugal separator of this invention with the centrifugal clutch option will now be described. While the description of the preferred embodiment of the centrifugal separator is described having a centrifugal clutch, it is emphasized that other clutch mechanisms are acceptable. At the beginning of operations, the drive motor 12 begins turning. The scraper shaft 42, which is directly connected to the drive motor 12, therefore begins rotating also. As the drive motor 12 increases in speed and moves beyond the predetermined low threshold RPM, the centrifugal clutch 14 will engage the bell housing 54, thus locking the bowl 18 into synchronous speed with the scraper 20. When the centrifugal clutch 14 is fully engaged, the shaft 42, spindle member 40, scraper 20 and bowl 18 are all rotating at the same speed, being powered by the directly coupled drive motor 12.

When all components of the centrifugal separator are running synchronously at the same speed, the dirty coolant or fluid is injected into the bowl 18. The bowl 18 fills with the injected fluid and the particles that are suspended in the fluid are forced onto the interior surface 28 of the bowl 18 by centrifugal force. Over time, the particulate form a layer, known in the industry as cake, on the interior surface 28 of the bowl 18. When the cake accumulates to a predetermined thickness, measured either by timing or load sensing, the fluid flow is discontinued. The bowl and scraper blade continue running synchronously for a short period of time to ensure that the last of the injected fluid is centrifuged to allow the particulate to cake the interior surface 18 of the bowl. The drive motor then begins a controlled slow down in rotational speed, causing the bowl 18 and scraper blade 20 to synchronously ramp down. The controlled reduction in speed allows the fluid remaining in the bowl 18 to drain through the bottom 38 in such a manner that the cake build up on the interior surface 28 of the bowl 18 remains undisturbed.

When the drive motor, bowl and scraper come to a complete stop, the bowl is locked down, usually with a locking pin (not shown) and the motor 12 is again activated. The motor 12 continues running at a slow speed, below the predetermined low threshold, so as not to engage the clutch 14. The slow speed of the drive motor 12 causes the scraper blade 20 to operate at the slow speed, causing relative motion between the bowl 18 and scraper blade 12. Commonly, the scraping cycle consists of the scraper blade 20 running forward for a programmed period of time then operating in reverse for a programmed period of time until the cake is cleared off of the interior surface 28 of the bowl 18. This back and forth motion breaks up the cake causing it to fall through the bottom 38 of the bowl 18 into a collection hopper (not shown). When the cleaning operation is finished, the bowl 18 is unlocked and the drive motor is accelerated beyond the predetermined low threshold speed to engage the bowl 18 with the clutch 14 and begin synchronous operation again.

As stated earlier, other clutch mechanisms can be incorporated with the centrifugal separator of this invention. The operation of the centrifugal separator remains the same with the exception that activation of the clutch mechanism is not dependent upon the drive motor 12, scraper blade 20, and shaft 42 reaching a predetermined low threshold speed. The clutch 14 can be activated by the operator or automatically through programming.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. In a centrifugal separator having a centrifuge bowl defining an interior cavity and an axial centerline; a scraper blade positioned within the interior cavity for rotational movement synchronous with the centrifuge bowl and rotational movement independent from the centrifuge bowl; a shaft member aligned with the axial centerline of the centrifuge bowl, one end the shaft member attached at one end to the scraper blade; a spindle member positioned about a portion of the shaft member and being attached at a first end to the centrifuge bowl, the opposed end of the spindle member and the shaft member both engaged with a clutch member for engaging and disengaging the shaft member with the spindle member; the invention comprising a single drive motor directly engaged with the opposed end of the shaft member that is in opposition to the end of the shaft member engaged with the scraper blade, the single drive motor being aligned with the axial centerline of the bowl, wherein the direct engagement between the single drive motor and the scraper blade drives the scraper blade independent of the centrifugal bowl to provide the high torque necessary to scrape the interior cavity of the bowl and wherein the clutch member engages to lock the shaft member and spindle member together only when the centrifugal bowl and scraper blade are intended to operate at a synchronous speed.

2. The centrifugal separator of claim 1 wherein the drive motor is a servo motor responsive to the load created by the rotating centrifuge bowl.

3. The centrifugal separator of claim 1 wherein the clutch member is a centrifugal clutch which engages the spindle member with the shaft member when the shaft member reaches a predetermined threshold speed and disengages if the speed of the shaft member drops below the predetermined threshold speed.

4. The centrifugal separator of claim 3 wherein the drive motor is a servo motor responsive to the load created within the rotating centrifuge bowl and drops the rotational speed below the predetermined threshold speed upon sensing a predetermined load on the centrifuge bowl.

5. In a centrifugal separator having a centrifuge bowl, the bowl defining a cavity having an interior surface and an axial centerline, an upper end, a lower end, and an axial centerline wherein the lower end has an opening communicating with the cavity; a hollow spindle connected to the upper end of the bowl in alignment with the axial centerline of the bowl; a scraper located within the cavity of the bowl; a shaft having an upper end and a lower end, the lower end of the shaft engaged with the scraper, the shaft extending through the hollow spindle in alignment with the axial centerline of the bowl; and a clutch member engaged between the shaft and spindle; the invention comprising having the upper end of the shaft directly engaged with a single drive motor aligned with the axial centerline of the bowl such that the drive motor directly powers the scraper blade to provide the high torque necessary to scrape the interior surface of the centrifuge bowl when the bowl is not in motion and further, the clutch member engages the shaft with the spindle when it is desired to rotate the scraper blade and bowl at a synchronous speed.

6. A centrifugal separator according to claim 5 wherein only the scraper is rotatable within the, bowl at or below a predetermined threshold speed for dislodging solids accumulated on the interior surface of the bowl.

7. A centrifugal separator according to claim 5 wherein both the scraper and bowl are rotatable during a high speed separation operation to substantially separate any solids and liquids.

8. A centrifugal separator according to claim 5 wherein the shaft and spindle are mechanically coupled together by a centrifugal clutch during a high speed separation operation so as to prevent relative movement therebetween during the separation operation.

9. The centrifugal separator of claim 5 wherein the drive member is a servo motor directly engaged with the shaft.

10. The centrifugal separator of claim 9 wherein the servo motor includes a speed adjustment means responsive to the load within the centrifuge bowl, wherein the motor slows the speed of rotation to disengage rotation of the bowl and initiate a scraping process of the interior surface of the bowl by the continually rotating scraper.

11. A method for separating particulate from particulate laden fluid by means of a centrifugal separator comprising the steps of:

initiating power to a drive motor engaged with an end of a shaft member, the shaft member being directly connected at another end to a scraper blade located within a centrifuge bowl defining an axial centerline; the drive motor being aligned with the axial centerline of the bowl;

accelerating the drive motor speed and shaft speed above a predetermined threshold speed to activate a centrifugal clutch located between the shaft member and a spindle member that is directly connected to the centrifuge bowl, wherein such activation causes the clutch to engage the shaft member with the spindle to cause the bowl to rotate synchronously with the scraper blade;

accelerating the rotating bowl and scraper blade to a predetermined high speed;

injecting particle laden fluid into the bowl to fill the bowl, wherein the particulate suspended in the fluid is forced to the bowl inner interior surface by centrifugal force;

continuing rotation of the bowl and scraper blade to form a layer of particulate on the interior wall;

sensing that the particulate has accumulated to a predetermined thickness;

reducing speed of the drive motor to allow the cleansed fluid to drain from the centrifugal bowl;

stopping the drive motor to stop the bowl and scraper blade rotation;

locking the bowl in a fixed position; and reactivating the drive motor to run at a slow speed with high torque, thereby causing the scraper to rotate within the locked bowl to break up the accumulated particulate.

12. The method of claim 11 wherein the accumulated thickness of particulate is sensed by a load sensing mechanism.

13. The method of claim 11 wherein the scraper blade is rotated forward and backyard within the bowl to scrape the accumulated particulate off of the interior surface of the bowl.

14. A method for separating particulate from particulate laden fluid by means of a centrifugal separator comprising the steps of:

initiating power to a drive motor engaged with an end of a shaft member, the shaft member being directly connected at another end to a scraper blade located within a centrifuge bowl defining an axial centerline; the drive motor being aligned with the axial centerline of the bowl:

activating a clutch mechanism to engage to the scraper blade and centrifuge bowl to cause the scraper blade and centrifuge bowl to rotate synchronously;

injecting particle laden fluid into the bowl to fill the bowl, wherein the particulate suspended in the fluid is forced to the bowl inner interior surface by centrifugal force;

continuing rotation of the bowl and scraper blade to form a layer of particulate on the interior wall;

sensing that the particulate has accumulated to a predetermined thickness;

reducing speed of the drive motor to allow the cleansed fluid to drain from the centrifuge bowl;

stopping the drive motor to stop the bowl and scraper blade rotation;

locking the bowl in a fixed position and disengaging the clutch mechanism; and reactivating the drive motor to cause the scraper blade to rotate within the locked bowl to break up the accumulated particulate.

15. The method of claim 14 wherein the accumulated thickness of the particulate is sensed by a load sensing mechanism.

16. The method of claim 14 wherein the scraper blade is rotated forward and backward within the bowl to scrape the accumulated particulate off the interior surface of the bowl.

* * * * *